US005655357A

United States Patent [19]

Kristen

[11] Patent Number: 5,655,357

[45] Date of Patent: Aug. 12, 1997

[54] EXHAUST FLOW RATE VACUUM SENSOR

[75] Inventor: Hanns J. Kristen, San Anselmo, Calif.

[73] Assignee: Tilia International, Inc., Kowloon, Hong Kong

[21] Appl. No.: 434,039

[22] Filed: May 2, 1995

[51] Int. Cl.[6] ..... B65B 31/00

[52] U.S. Cl. ..... 53/512; 53/52; 53/75

[58] Field of Search ..... 53/510, 511, 512, 53/562, 75, 76, 52; 310/338; 73/702, 704, 651, 653, 204.19, 204.26, 861.08, 861.18, 861.21, 861.24, 861.74, 861.75, 861.76

[56] References Cited

U.S. PATENT DOCUMENTS

| | | | |
|---|---|---|---|
| 3,625,058 | 12/1971 | Endress et al. . | |
| 3,953,819 | 4/1976 | Keerie et al. | 73/861.76 |
| 4,351,192 | 9/1982 | Toda et al. | 73/861.18 |
| 4,409,840 | 10/1983 | Roberts . | |
| 4,455,874 | 6/1984 | Paros . | |
| 4,488,439 | 12/1984 | Gast et al. . | |
| 4,625,565 | 12/1986 | Wada et al. | 73/861.74 |
| 4,725,700 | 2/1988 | Zoludow | 73/861.76 |
| 4,739,664 | 4/1988 | Hetrick | 73/704 |
| 4,757,720 | 7/1988 | Tanaka | 73/861.24 |
| 4,845,927 | 7/1989 | Rapparini . | |
| 4,922,686 | 5/1990 | Segota | 53/512 |
| 4,941,310 | 7/1990 | Kristen | 53/512 |
| 4,945,344 | 7/1990 | Farrell et al. | 73/861.74 |
| 5,048,269 | 9/1991 | Deni | 53/512 |
| 5,063,781 | 11/1991 | Conforti et al. | 73/653 |
| 5,071,667 | 12/1991 | Grune et al. . | |
| 5,120,951 | 6/1992 | Small | 73/861.71 |
| 5,168,192 | 12/1992 | Kosugi et al. | 73/715 |
| 5,215,445 | 6/1993 | Chen | 53/512 |
| 5,237,867 | 8/1993 | Cook, Jr. | 73/204.26 |
| 5,239,808 | 8/1993 | Wells et al. | 53/512 |
| 5,243,858 | 9/1993 | Erskine et al. | 73/204.26 |
| 5,315,807 | 5/1994 | Restle et al. | 53/562 |
| 5,406,776 | 4/1995 | Cappi et al. | 53/512 |
| 5,515,714 | 5/1996 | Sultan et al. | 73/204.26 |
| 5,551,213 | 9/1996 | Koelsch et al. | 53/512 |

FOREIGN PATENT DOCUMENTS

| | | | |
|---|---|---|---|
| 0574650 | 9/1977 | U.S.S.R. | 73/704 |
| 2211161 | 6/1989 | United Kingdom | 53/512 |

*Primary Examiner*—John Sipos
*Assistant Examiner*—Ed Tolan
*Attorney, Agent, or Firm*—Fliesler, Dubb, Meyer & Lovejoy

[57] ABSTRACT

A vacuum sensor for use in devices for the vacuum packaging of perishable items. The vacuum sensor senses fluid pulses or flow expelled from an exhaust port of a pump of the vacuum packaging device. The sensor converts a force of the fluid pulses or flow into a signal that changes with a change in the force of the fluid pulses or flow. The signal is then communicated to a control circuit which uses the signal to display the progress of the vacuum process and/or shut down the pump upon establishing a substantial vacuum within the package.

14 Claims, 5 Drawing Sheets

EXHAUST FLOW RATE VACUUM SENSOR

CROSS REFERENCE TO RELATED APPLICATIONS

The present application is related to applicant's U.S. Pat. No. 4,941,310 entitled "APPARATUS FOR VACUUM SEALING PLASTIC BAGS", issued Jul. 17, 1990, which patent is owned by the assignee of the present invention, and which patent is incorporated by reference herein in its entirety.

BACKGROUND OF THE INVENTION

1. Field of the Invention

The present invention relates to a device for vacuum sealing containers, and in particular to a device for sensing the presence of a fluid pumped out of a container, and converting the sensor output to a signal for indicating the formation of a vacuum within the container.

2. Description of the Related Art

Various apparatus and methods are known for the purpose of vacuum sealing containers to protect perishables provided therein, such as foodstuffs and other products, against oxidation. One type of vacuum sealing system, primarily used for commercial packaging purposes, includes a vacuum chamber in which the entire packaged product is placed, along with heat sealers for sealing the package once a vacuum has been substantially established within the interior of the package.

Another type of conventional vacuum sealing system is manufactured to be more compact and economical for home use. One such system is disclosed in applicant's U.S. Pat. No. 4,941,310, previously incorporated by reference, which in one embodiment discloses a vacuum chamber including an opening defined by a stationary support member and a moveable hood. An open end of a container such as a bag to be sealed is received within the vacuum chamber between the support member and the moveable hood, such that when the hood is moved to a closed position, a sealed environment including the vacuum chamber and the interior of the bag is established. A preferred type of bag for use with such a system is disclosed in applicant's U.S. Pat. No. 4,756,422, entitled, "PLASTIC BAG FOR VACUUM SEALING", which bag is provided with a series of air channels on interior surfaces of the bag. The air channels allow fluid flow from the bag into the vacuum chamber, thereby allowing evacuation of the bag even though the open end of the bag is firmly held between the support member and moveable hood.

After the moveable hood is located in the closed position with the open end of the bag located within the vacuum chamber, a pump within the device evacuates the fluid from within the bag. Once a vacuum is substantially established within the bag, a heat source seals the opening of the bag thereby vacuum sealing the perishable goods within the bag.

Systems for vacuum packaging perishable items such as those described above conventionally employ pressure sensors for determining when a sufficient vacuum is established within the vacuum chamber and vacuum-seal bag. Such pressure sensors conventionally operate by comparing the interior chamber/container pressure to a reference pressure, which is generally ambient pressure. A control mechanism shuts down the evacuation pump when a pressure differential between the chamber/container interior and reference pressures reaches a predetermined value, thereby indicating a substantial vacuum within the chamber and container. However, a shortcoming with conventional pressure sensors used in vacuum packaging devices is that the reference pressure may change significantly with a change in temperature and/or elevation. For example, if a vacuum packaging device including a conventional pressure sensor is used in a low elevation/high pressure location, the predetermined pressure differential between the chamber/container interior and reference pressure may be reached prematurely, and the pump may be shut down prior to complete evacuation of the fluid from within the container to be vacuum sealed. Conversely, if a vacuum packaging device including a conventional pressure sensor is used at a high elevation/low pressure location, the predetermined pressure differential may never be reached, and consequently the evacuation pump will continue to operate even though a vacuum has been substantially established within the vacuum-seal container.

SUMMARY OF THE INVENTION

It is therefore an object of the present invention to provide a vacuum sensor for use within a vacuum packaging device for indicating the formation of a vacuum within a vacuum-seal container independently of the surrounding ambient pressure.

It is a further object of the present invention to provide a vacuum sensor for use within a vacuum packaging device which allows a dynamic indication of the extent to which a vacuum has been formed within a vacuum-seal container as the chamber and container are evacuated.

It is a still further object of the present invention to provide a vacuum sensor which is extremely sensitive so as to measure and differentiate between minimal changes in the amount of fluid within a vacuum chamber and vacuum-seal container.

It is another object of the present invention to provide a vacuum sensor for use within a vacuum packaging device which may be easily incorporated into existing vacuum packaging device designs.

It is a still further object of the present invention to provide a vacuum sensor for use within a vacuum packaging device, which sensor is compact and inexpensive to manufacture so as not to substantially affect the overall size or fabrication cost of the vacuum packaging device.

These and other objects are accomplished by the present invention, which relates in general to a vacuum sensor for use in devices for the vacuum packaging of perishable items. In general, a vacuum packaging device includes a vacuum chamber in communication with an interior of a container to be vacuum sealed, and an evacuation pump for evacuating fluid, generally air from the surrounding environment, from the vacuum chamber and vacuum-seal container. Fluid exits the pump through an exhaust port to the environment surrounding the vacuum chamber. In one embodiment of the invention, a vacuum sensor includes a vibration member fixedly mounted adjacent the exhaust port so as to be within an exit stream of the fluid expelled from the exhaust port. The evacuation pump typically includes a piston which expels fluid from the pump in short, rapid fluid pulses. These pulses strike a surface of the vibration member, thereby causing the member to vibrate. As a vacuum forms within the vacuum chamber and container, the force of the fluid pulses from the exhaust port diminishes, thereby causing an accompanying decrease in the vibrational amplitude of the vibration member.

In one embodiment of the present invention, the vibration member is comprised of a piezoelectric material which is capable of converting vibrational amplitude of the member due to the fluid pulses into an electrical signal. As the electrical signal will alternate with the up and down vibrational swing of the member, an AC current signal is generated having a frequency equal to the frequency of vibration and a voltage that increases and decreases with the amplitude of vibration. As the density of fluid within the vacuum chamber and vacuum-seal container decreases, the force of the fluid pulses expelled from the exhaust port will decrease. The decrease in the fluid pulse force in turn decreases the vibrational amplitude of the vibration member, which in turn decreases the voltage of the generated fluid pulse signal.

While a preferred embodiment utilizes a piezoelectric material that vibrates to generate a signal representative of the force of the fluid pulses expelled from the pump exhaust port, it is understood that various other transducing systems may be utilized to generate a signal representative of the force of the expelled fluid. For example, the vacuum sensor may comprise a magnet moving within an induction coil. The coil generates a current signal according to known electromagnetic principles, which signal varies with the degree of movement of the magnet. Moreover, it is contemplated that the fluid expelled from the exhaust port may exit in a steady, non-pulsed fluid flow. In this embodiment, the vacuum sensor may for example comprise a light source that directs a light off a reflective member that is deflected by the stream of the exiting fluid. This embodiment further includes a sensor for receiving a portion of light reflected off the reflective member, the sensor generating a signal based on the amount of light received therein. Some transducing systems may generate an electrical signal from the expelled fluid where the fluid is expelled either in pulses or in a steady flow, such as for example the above-described light sensing system, or a system including a thermistor which generates a signal depending on the degree to which the thermistor is cooled by the expelled fluid.

After the signal indicating the fluid pulse force or flow rate is generated, the signal is input to a control circuit preferably included as part of the main control circuit controlling the overall operation of the vacuum packaging device. The control circuit receives the fluid indication signal from the vacuum sensor, via a conventional amplification circuit, and thereafter performs any of several functions based on the voltage of the fluid indication signal. For example, a dynamic vacuum indicator may be provided as a visual display on a surface of the vacuum packaging device. The dynamic vacuum indicator may be any of several conventional visual indicators. For example, the display may be in the form of a series of light emitting diodes which successively turn on or off to show the gradual formation of a vacuum within the vacuum chamber and vacuum-seal container. Alternatively, the display may be a liquid crystal display for verbally or numerically indicating the gradual formation of a vacuum within the vacuum chamber and vacuum-seal container. Furthermore, the control circuit may turn off the evacuation pump when the voltage of the fluid indication signal falls below a threshold value indicating that a vacuum has been substantially established within the vacuum chamber and vacuum-seal container.

BRIEF DESCRIPTION OF THE DRAWINGS

The invention will now be described with reference to the figures in which.

DETAILED DESCRIPTION

The invention will now be described with reference to FIGS. 1A through 7 which in general relate to a vacuum sensor for use within a vacuum packaging device such as that disclosed in U.S. Pat. No. 4,941,310 for vacuum sealing a container. However, it is understood that the vacuum sensors according to the present invention may be used with vacuum packaging devices of various designs including both vacuum packaging devices for industrial or home usage. Moreover, it is understood that the container to be vacuum sealed may be any of various bags, jars or other sealable vessels.

Figure 1A:
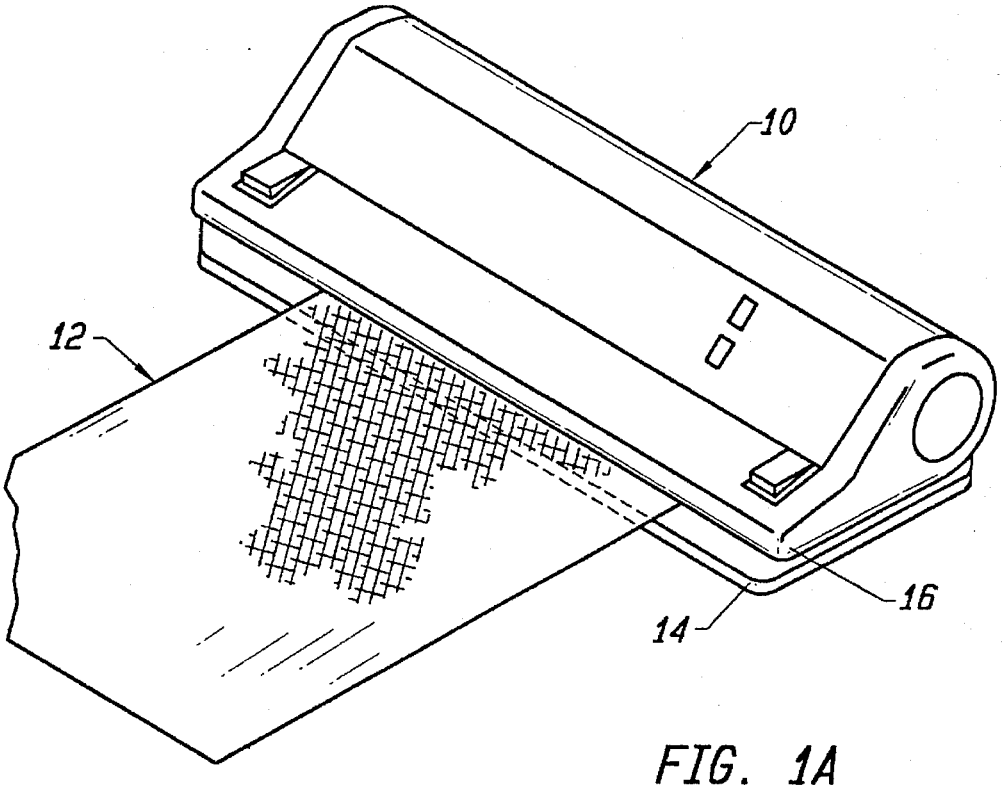
FIG. 1A is a perspective view of a vacuum packaging device shown from the front with a vacuum-seal container provided therein.
Figure 1B:
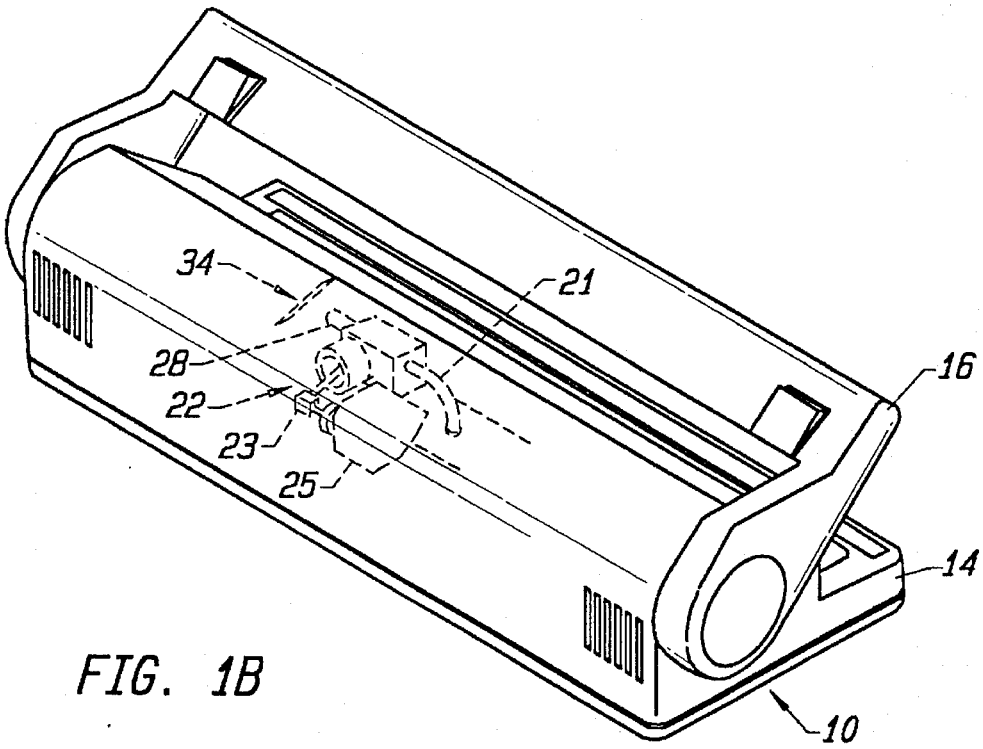
FIG. 1B is a perspective view of a vacuum packaging device shown from the rear.
Figure 1C:
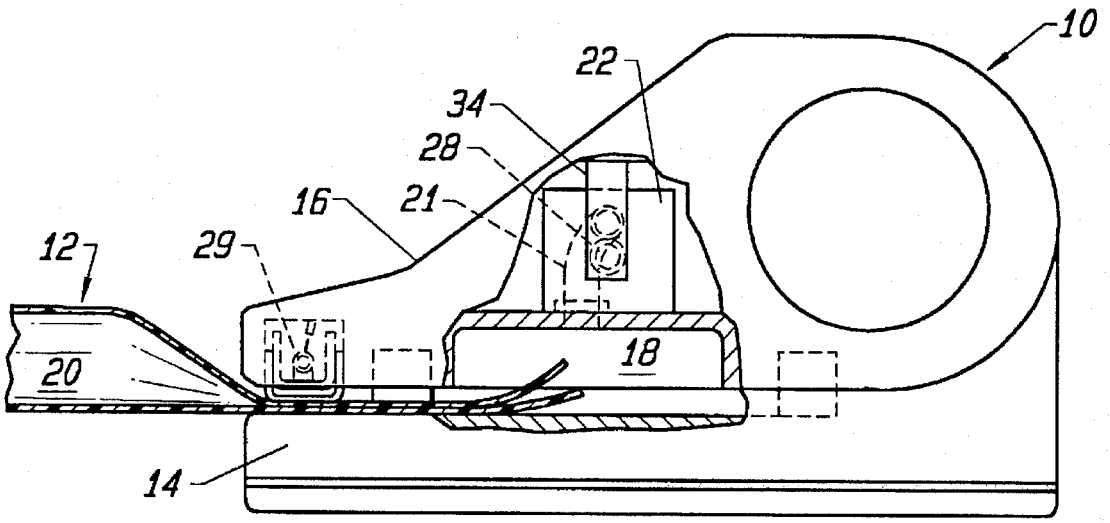
FIG. 1C is a side cross sectional view of a vacuum packaging device including the present invention.

Referring now to FIGS. 1A through 1C, a vacuum packaging device 10 is shown for evacuating and sealing a vacuum-seal container 12. Although not critical to the invention, in one embodiment, container 12 may be a heat sealable thermoplastic package such as that taught in U.S. Pat. No. 4,756,422, previously incorporated by reference. In general, vacuum packaging device 10 includes a stationary base member 14, and a hood 16 moveable between a first, open position (shown in FIG. 1B) and a second, closed position (shown in FIGS. 1A, 1C). Where container 12 comprises a sealable bag, an open end of the bag is inserted between the support member 14 and hood 16, and then hood 16 is locked into the closed position. In the closed position, a sealed environment is created including a chamber interior 18 and a container interior 20. Thereafter, fluid, generally air from the surrounding environment, is evacuated from the sealed environment defined by interiors 18 and 20 by activation of an evacuation pump 22 by a control circuit 24. As seen in FIGS. 1B and 1C, fluid is drawn from interiors 18, 20 through line 21 by the pump and expelled out of exhaust port 28. Evacuation pump is preferably a conventional mechanical pump including a piston 23 reciprocated by a drive mechanism 25, which piston reciprocation expels fluid from the sealed environment in short, rapid pulses. Evacuation pump may alternatively be of a kind that expels fluid in a steady, non-pulsed fluid flow.

As will be described in greater detail below, evacuation pump 22 continues evacuation of fluid from interiors 18 and 20 until a vacuum sensor 26 according to the present invention indicates that a vacuum has been substantially established within interiors 18 and 20. Thereafter, the overall control circuit activates heating mechanism 29 to thereby seal the open end of container 12. Once container 12 is sealed, the hood 16 may be opened and the vacuum sealed container 12 removed.

A vacuum sensor 26 according to the present invention will now be described with reference to FIGS. 2 through 7.

Figure 2:
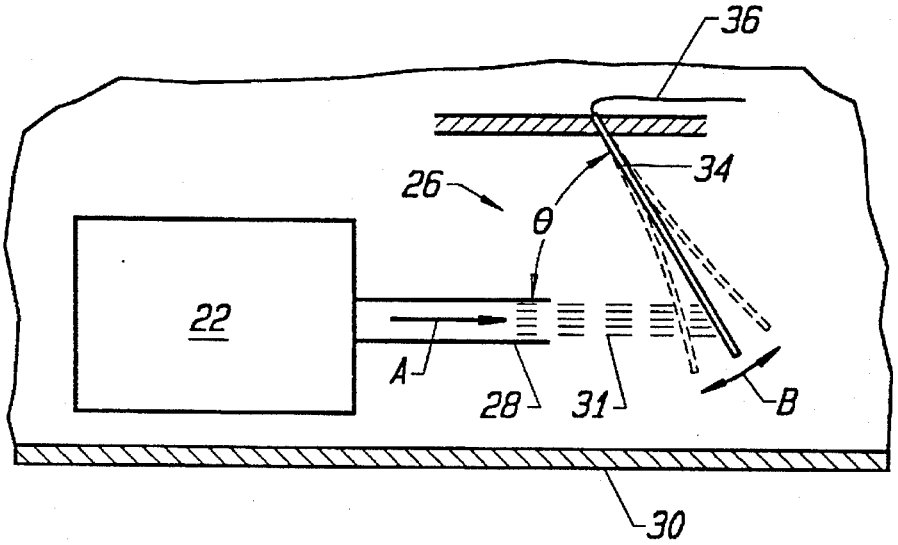
FIG. 2 is an enlarged cross sectional side view of a vacuum sensor according to the present invention located adjacent an exhaust port of the vacuum packaging device.

FIG. 2 is an enlarged cross sectional side view of a portion of vacuum packaging device 10, including the pump 22, exhaust port 28, and the vacuum sensor 26. During operation of the vacuum packaging device 10, fluid is pumped out of the chamber interior 18 and container interior 20 as described above, and expelled from the device 10 via exhaust port 28 in the direction of arrow A in FIG. 2.

In a preferred embodiment of the invention, vacuum sensor 26 includes a vibration member 34 secured adjacent to the exhaust port 28 within the exit stream of the expelled fluid. In a preferred embodiment, the vibration member may be oriented with respect to the fluid pulse stream as shown in FIG. 2 at an angle θ of approximately 60°–65°. However, it is understood that this angular range is not intended to limit the present invention, and that the vibration member 34 may be provided at other angles θ less than, greater than or equal to 90° with respect to the fluid pulse stream in alternative embodiments of the present invention. The exhaust port 28 and the vibration member 34 are preferably located within a housing of the vacuum packaging device 10 to prevent external air currents from affecting the member 34.

As described above, in one embodiment of the invention, fluid is expelled from the pump 22 in short, rapid pulses at a frequency equal to the frequency of the reciprocating piston. Such pulses are shown symbolically at reference numeral 31. A fluid pulse 31 strikes the vibration member 34, thereby deflecting the vibration member in a first direction away from the source of the fluid pulse. After the fluid pulse passes the vibration member, the member swings back in the opposite direction. At some time during the return swing, the next subsequent fluid pulse strikes the vibration member 34, thereby once again deflecting the member back in the first direction. In this manner, the fluid pulses cause the vibration member to vibrate. As would be understood by those skilled in the art, the dimensions and material of the vibration member 34 are selected so that the frequency of the fluid pulses causes vibration of the vibration member as described above. For example, with a pump operating at a frequency of approximately 50 cycles per second, the vibration member 34 may be comprised of a thin flexible reed-like, piezoelectric element having a length of approximately 1 inch, a width of approximately 0.5 inches, and a thickness of approximately 8 mils. It is understood that the dimensions of vibration member 34 may vary in alternative embodiments, with the limitation that the dimensions not be those at which resonance occurs in the vibration 34 for a particular pump frequency.

As the fluid is pumped out and a vacuum is formed within the chamber and container interiors 18, 20, the fluid density within interiors 18 and 20 decreases. The decrease in fluid density results in a decrease in the force of the exiting fluid pulses which force decrease in turn results in a decrease in the vibrational amplitude of the member 34.

When evacuation of the chamber and container interiors 18, 20 begins, it is contemplated that the force of the exiting fluid pulses upon the vibration member 34 may exceed the force necessary to vibrate member 34 at a maximum vibrational amplitude for member 34. In this event, at some point during the evacuation of fluid, the diminishing force of the fluid pulses will cause the vibration member 34 to vibrate at an amplitude less than the maximum vibrational amplitude of the member 34 as described above. It is not critical to the present invention whether the pulses initially exiting the exhaust port have a force greater than or less than that necessary to vibrate member 34 at its maximum vibrational amplitude. And, should the pulses initially exiting the exhaust port have a force greater than that necessary to vibrate member 34 at its maximum vibrational amplitude, it is not critical to the present invention to identify the point at which the member 34 begins to vibrate at less than its maximum vibrational amplitude. It is important only that, at some point during the evacuation of fluid from chamber and container interiors 18, 20, the vibrational amplitude of the member 34 will decrease due to a decrease in the pulse force of the exiting fluid. The material and dimensions of vibration member 34 are selected so that vibration member 34 is extremely sensitive to a change in the fluid pulse force. Therefore, even a slight decrease in the fluid pulse force of the expelled fluid will result in a decrease in the vibrational amplitude of member 34 when the fluid pulse force is below the above-described point. In a preferred embodiment of the invention, vibration member 34 is formed of a piezoelectric film. Alternatively, member 34 may be comprised of a thin substrate having one or more layers of a piezoelectric material provided thereon. An example of such a piezoelectric film exhibiting good flexibility is polyvinylidene flouride ($PVF_2$), although several other piezoelectric materials may be used. It is well known that piezoelectric elements can be used as electromechanical transducers for converting a mechanical deformation of an element into an electrical signal and visa-versa. The vibration of vibration member 34 will create a current in a first direction along the length of member 34 during a deformation of member 34 in one direction, and a current in a second, opposite direction along the length of member 34 during a deformation of member 34 in the opposite direction. Therefore, vibration of vibration member 34 creates a fluid indication signal comprised of an AC current, which signal has a frequency equal to the frequency of vibration, and a voltage indicative of the amplitude of vibration.

Figure 3:
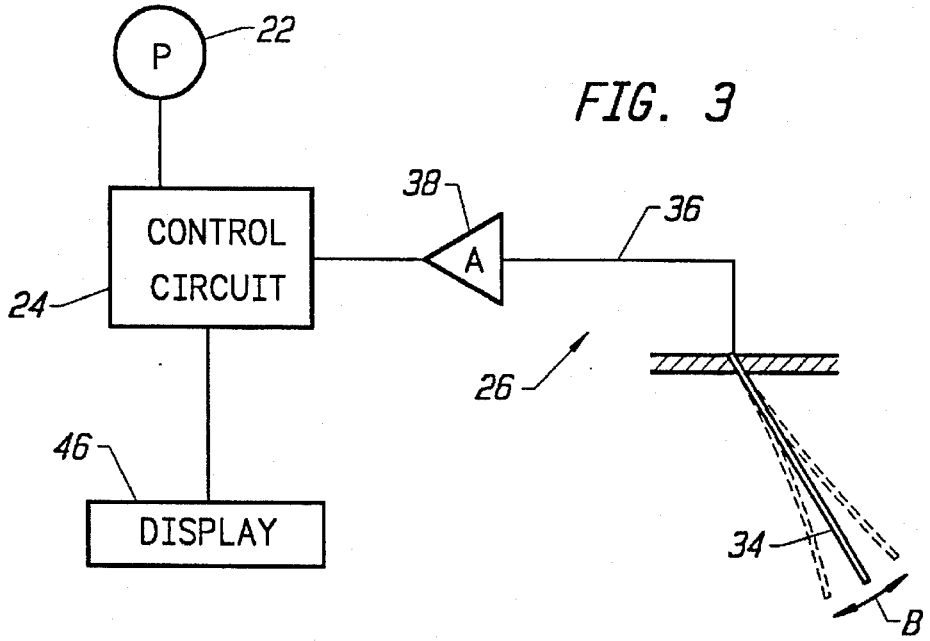
FIG. 3 is a schematic circuit diagram illustrating a vacuum sensor and control circuit according to the present invention.
Figure 4:
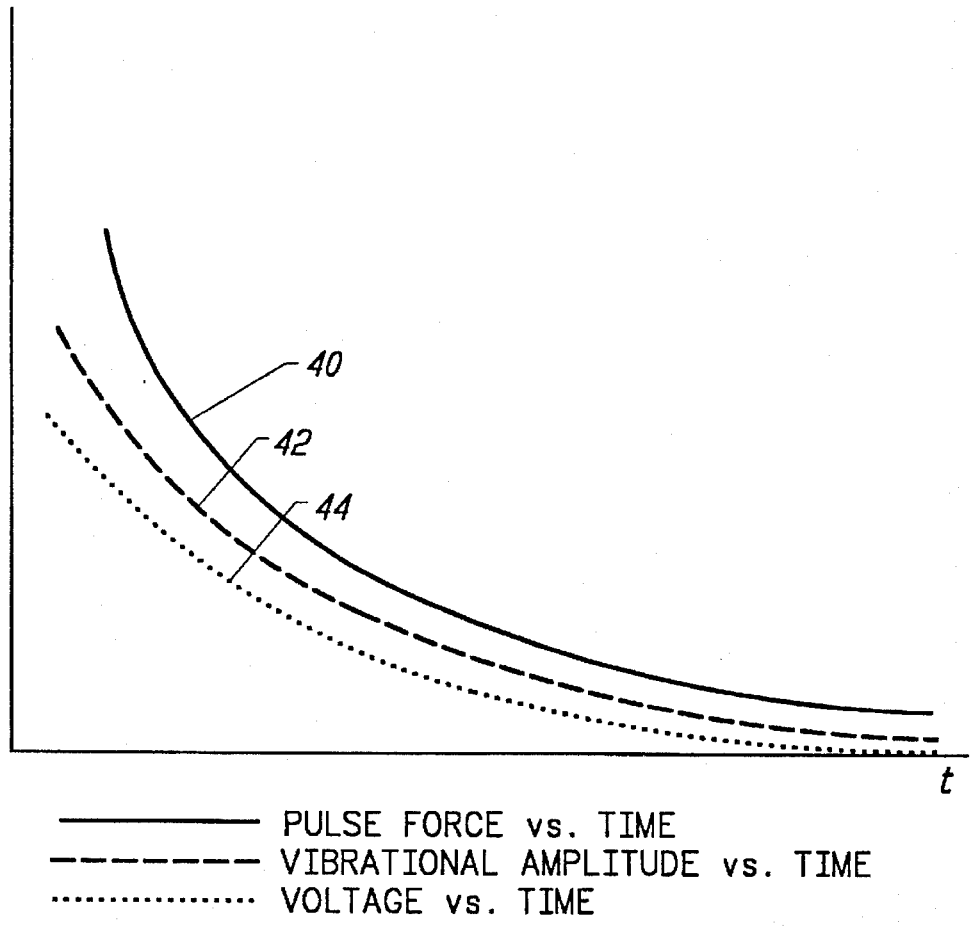
FIG. 4 is a graph showing plots of fluid pulse force versus time, vibrational amplitude versus time, and electrical signal voltage versus time.

As seen in FIGS. 2 and 3, a lead 36 electrically coupled to member 34 carries the fluid indication signal from the member 34 to a conventional amplifier circuit 38 for amplification of the fluid indication signal. From amplification circuit 38, the amplified fluid indication signal is communicated to the control circuit 24. In a preferred embodiment, the control circuit 24 is integrated into the overall control circuit for controlling and coordinating the operation of each of the components within vacuum packaging device 10.

The fluid indication signal is related to the vibrational amplitude of the vibration member 34 such that the voltage of the fluid indication signal, as well as the amplified fluid indication signal, will decrease as the vibrational amplitude of member 34 decreases. A plot of fluid pulse force versus time, vibrational amplitude versus time, and the voltage of the fluid indication signal versus time is shown by plots 40, 42, and 44, respectively, in FIG. 4. The relationship between fluid pulse force, vibrational amplitude and fluid indication signal voltage is shown as being generally proportional to each other. However, it is understood that there may be linear or nonlinear relationship between the fluid pulse force and vibrational amplitude, and the vibrational amplitude and fluid indication signal voltage, respectively.

Once the amplified fluid indication signal is received within the control circuit 24, the circuit 24 may use the signal to display the progress of the fluid evacuation process on a display 46. As would be appreciated by those skilled in the art, the display 46 preferably shows a visual representation of the vacuum formation within the vacuum chamber and vacuum-seal container interiors 18, 20. It is contemplated that display 46 may provide an audio representation instead of or in addition to the visual representation.

The amplified fluid indication signal communicated to the control circuit 24 changes with a change in the amount of fluid within container 12. Therefore, it would further be appreciated by those skilled in the art that the amplified fluid indication signal may be used by the control circuit 24 to generate a dynamic and continuously updated visual representation of the amount of fluid remaining within the container 12. This allows a user of the vacuum packaging device 10 to monitor the progress of the evacuation process carried out by the vacuum packaging device 10. The display 46 may provide a dynamic visual representation of the fluid density within container 12 in any of several conventional formats. For example, display 46 may be comprised of a plurality of light emmiting diodes which successively turn on or turn off as the amount of fluid within container 12 decreases. Alternatively, the display 46 may comprise a liquid crystal display ("LCD"). In this embodiment, the control circuit 24 uses the amplified fluid indication signal to generate an alpha-numeric representation of, for example, the instantaneous mount of fluid remaining within the container 12 at a given time during the evacuation process, which representation may then be displayed over the LCD. It is understood that display 46 may be configured to other known formats for displaying the progress of the evacuation of fluid from vacuum-seal container 12.

Receipt of the amplified fluid indication signal by control circuit 24 further allows control circuit 24 to shut down evacuation pump 22 when the voltage of the amplified fluid indication signal drops below a predetermined threshold value, which threshold value indicates that a vacuum has been substantially established within chamber interior 18 and container interior 20. The point at which the control circuit 24 shuts down pump 22 is solely dependent on the amount of fluid remaining within the vacuum chamber and vacuum-seal container interiors 18, 20 and the pulse force of the fluid expelled from exhaust port 28. Therefore, the pump 22 will shut down at substantially the same point after establishing a substantial vacuum in container 12 regardless of the ambient pressure surrounding the vacuum packaging device 10.

Figure 5A:
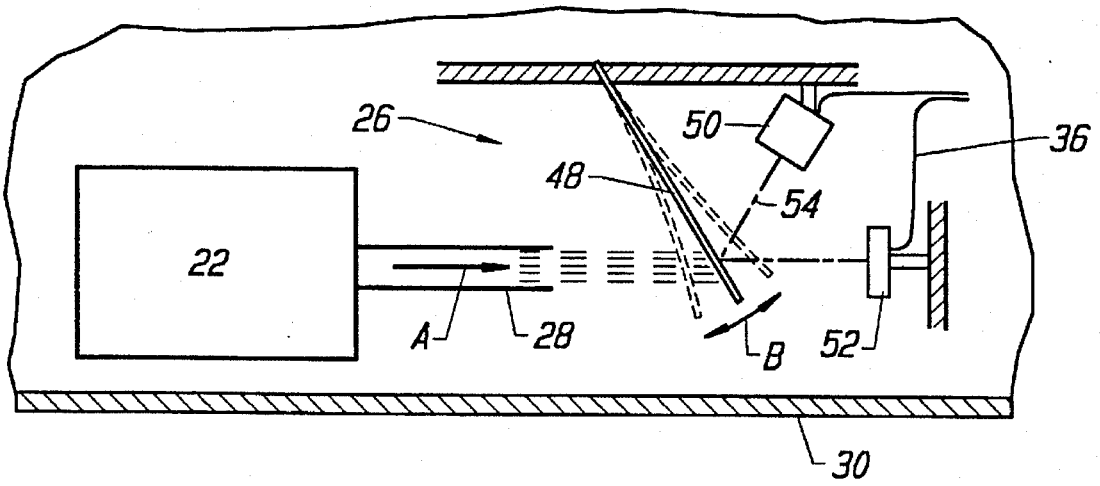
FIGS. 5A through 7 are enlarged cross sectional side sensors according to alternative embodiments of the present invention.
Figure 5B:
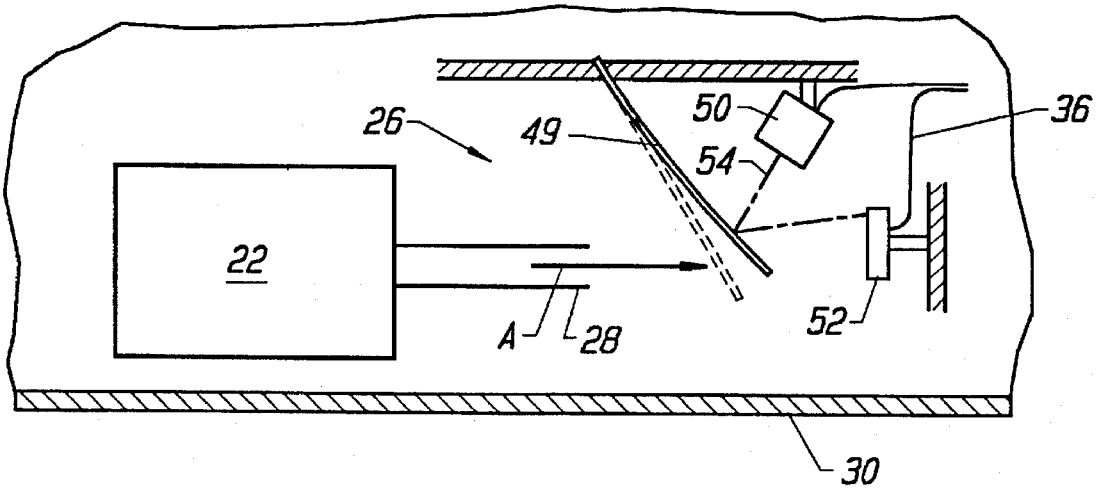

Up to this point, the vibration member 34 has been described as being a piezoelectric member. However, it is understood that any of various known systems may be employed which convert a vibrational motion into an electrical signal that changes with the amplitude of the vibrational motion. For example, an alternative embodiment of the present invention is shown in FIG. 5A, with like elements from the first described embodiment having the same reference numerals. In the embodiment of FIG. 5A, the vacuum sensor 26 is comprised of a vibration member 48 which is flexible and has a metallic or other similar surface having high reflectivity. Vacuum sensor 26 of this embodiment further includes a light source 50 and a light sensor 52. In operation, a light beam 54 from light source 50 is directed off of the reflective surface of vibration member 48 and is received in light sensor 52. During the initial stages of fluid evacuation, the fluid pulse force is high and the vibration member 48 has a large vibrational amplitude. At this point, only a small portion of light will be reflected off of member 48 and received in light sensor 52. However, as the fluid pulse force decreases and the vibrational amplitude of member 48 decreases, the amount of light sensed by light sensor 52 will increase. As is known in the art, the amount of light incident on light sensor 52 may be converted into an electrical signal within lead 36 that changes with a change in the amount of incident light. This electrical signal may be then be amplified and communicated to control circuit 24 for use in displaying the progress of the vacuum process and/or shutting down pump 22 as described above with respect to the first embodiment.

A variation of the embodiment shown in FIG. 5A is contemplated wherein light reflected off of vibration member 48 is reflected directly into a window (not shown) on the surface of vacuum packaging device 10 that is visible to a user. In this embodiment, activation of the vacuum packaging device 10 will turn on the light source 50. Initially, relatively little light is reflected into the window due to the large vibration of the member 48. However, as the vibrational amplitude of member 48 decreases, the amount of light reflected into the window and visually perceived by a user will increase. When the light reaches a certain intensity, a vacuum has been substantially established within the chamber and container interiors, and the user may then manually shut down the vacuum packaging device. In this embodiment, a light sensor as described above may be omitted and no electrical signal is generated.

Figure 6:
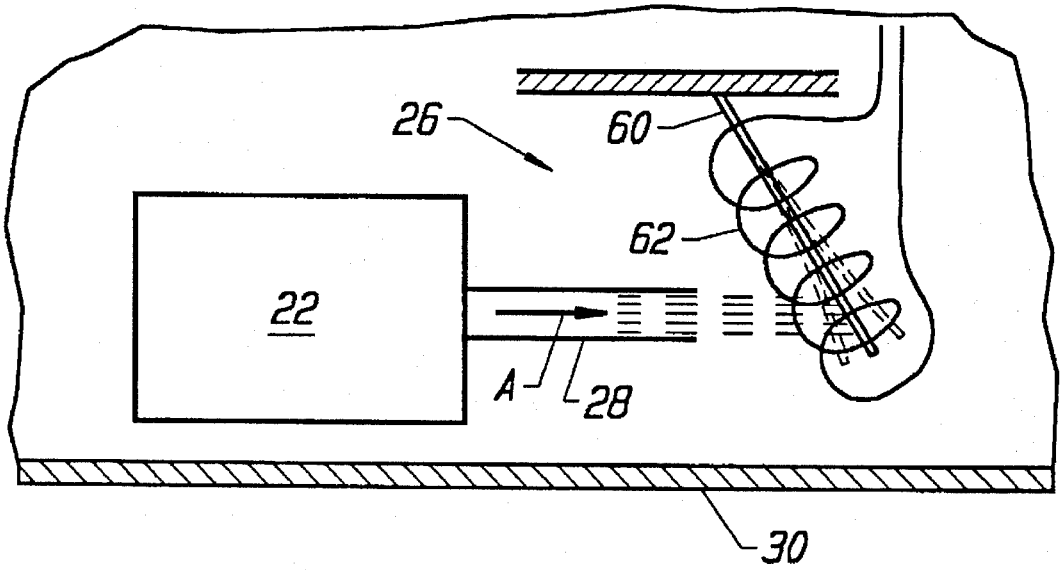
Figure 7:
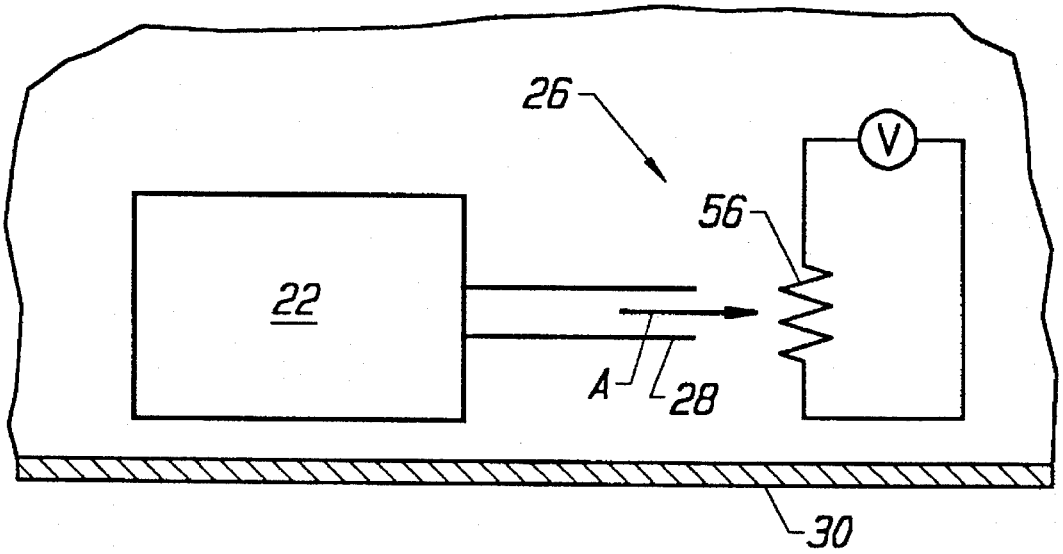

In a further embodiment shown in FIG. 6, the vacuum sensor according to the present invention may comprise a vibration member 60 that is a magnet oriented within the stream of the exiting fluid such that the fluid causes the magnetic vibration member 60 to vibrate within an induction coil 62 as described above with respect to vibration member 34. As is known in the art, vibration of magnetic vibration member 60 will induce a current signal within coil 62 that is proportional to the amplitude of vibration of member 60. This signal may then be amplified and communicated to control circuit 24 for use in displaying the progress of the vacuum process and/or shutting down pump 22 as described above with respect to the first embodiment.

The evacuation pump has been described above as expelling fluid in fluid pulses. However, conventional evacuation pumps are also known that expel fluid in a steady, non-pulsed fluid stream. Where such a pump is used within the vacuum packaging device 10, a member may be located within the stream of exiting fluid so as to cause the member to deflect away from the fluid stream. As is known in the art, several transducing systems may be used to generate a signal that changes with the degree of deflection of the member. For example, a conventional strain gauge may be used to measure the degree of deflection. As is known in the art, a signal may be generated by the strain gauge that changes with a change in the degree of deflection of the member (a conventional strain gauge may also be used to generate a signal based on vibration of a member due to pulsed fluid flow). Alternatively, the above-described light sensor systems may operate to measure deflection. With regard to FIG. 5B, a portion of light 54 reflected off of the deflected member 49 may be received within light sensor 52 to generate an electric signal within lead 36 that changes with the mount of light received. Alternatively, the reflected light may be received within a window for visual perception by a device user.

Moreover, in further embodiments of the invention, an electrical signal may be generated from the expelled fluid stream without using any vibration or deflection member. For example, in one such embodiment shown in FIG. 7, the vacuum sensor 26 may comprise a heat element, such as a thermistor 56, located within the exit stream of the fluid expelled from the exhaust port 28. A current through the thermistor will normally cause the thermistor to heat up. However, the expelled fluid acts to cool the thermistor until the fluid flow decreases, at which time the temperature of thermistor 56 increases. Thus, the temperature of the thermistor 56 is inversely related to the flow of the exiting fluid. As is known in the art, the temperature of the thermistor 56 may be converted into an electrical signal which is related to the temperature. This electrical signal may then be amplified and communicated to control circuit 24 for use in displaying the progress of the vacuum process and/or shutting down pump 22 as described above with respect to the first embodiment. The vacuum sensor of FIG. 7 may generate a signal where the evauction pump expels fluid in either fluid pulses or steady fluid flow.

Although the invention has been described in detail herein, it should be understood that the invention is not limited to the embodiments herein disclosed. Various changes, substitutions and modifications may be made thereto by those skilled in the art without departing from the spirit or scope of the invention as described and defined by the appended claims.

I claim:

1. In a vacuum packaging device including a pump for evacuating fluid from a container and expelling the evacuated fluid in fluid pulses out of an exhaust port, a vacuum sensor for sensing the formation of a vacuum within the container, comprising:

a member capable of receiving a flow of fluid pulses expelled from the exhaust port so that the fluid pulses vibrate said member, said member independently generating a signal from a force exerted by the fluid pulses on said member, said signal changing with a change in said force of the fluid pulses; and control means for receiving said signal and for controlling formation of the vacuum within the container based on said signal.

2. A vacuum sensor as recited in claim 1, wherein said member comprises a piezoelectric member.

3. A vacuum sensor as recited in claim 1, wherein said control means includes display means for displaying the extent to which the fluid has been evacuated from the container by said signal.

4. A vacuum sensor as recited in claim 1, wherein said control means includes means for shutting down the pump when said signal attains a threshold value.

5. In a vacuum packaging device including a pump for evacuating fluid from a container and expelling the evacuated fluid in a flow of fluid pulses out of an exhaust port, a vacuum sensor for sensing the extent to which fluid has been evacuated from the container, comprising:

a piezoelectric member located within a stream of the fluid expelled from the exhaust port, the flow of fluid pulses exerting a force on said deflection member so that said deflection member vibrates with an amplitude that changes with a change in the force of the fluid pulses;

transducing means for converting said amplitude into an electrical signal that changes with a change in said amplitude; and control means for receiving said electrical signal and for monitoring the extent to which the fluid has been evacuated from the container by said electrical signal.

6. A vacuum sensor as recited in claim 5, wherein said control means includes display means for displaying the extent to which the fluid has been evacuated from the container by said electrical signal.

7. A vacuum sensor as recited in claim 5, wherein said control means includes means for shutting down the pump when said electrical signal attains a threshold value.

8. In a vacuum packaging device including a pump for evacuating fluid from a container and expelling the evacuated fluid out of an exhaust port in fluid pulses, a vacuum sensor for sensing the formation of a vacuum within the container, comprising:

a piezoelectric member for location within a stream of the fluid pulses from the exhaust port, said member oriented at an angle of between approximately 60° to 65° with respect to a direction of said fluid pulses, so that the flow of fluid pulses exert a force to vibrate said vibration member with a vibrational amplitude that changes with a change in a force of the fluid pulses, said piezoelectric member generating an electrical signal that changes with a change in said vibrational amplitude; and control means for receiving said electrical signal and for monitoring the extent to which the fluid has been evacuated from the container by said electrical signal.

9. A vacuum sensor as recited in claim 8, wherein said control means includes display means for displaying the extent to which the fluid has been evacuated from the container by said electrical signal.

10. A vacuum sensor as recited in claim 8, wherein said control means includes means for shutting down the pump when said electrical signal attains a threshold value.

11. A vacuum sensor as recited in claim 1, wherein the fluid pulse pulses approximately 50 cycles per second.

12. A vacuum sensor as recited in claim 11, wherein said member has a length of approximately 1 inch, a width of approximately 0.5 inches, and a thickness of approximately 8 mils.

13. A vacuum sensor as recited in claim 8, wherein the fluid pulse pulses approximately 50 cycles per second.

14. A vacuum sensor as recited in claim 13, wherein said member has a length of approximately 1 inch, a width of approximately 0.5 inches, and a thickness of approximately 8 mils.

* * * * *